US005971515A

United States Patent [19]

Baker et al.

[11] Patent Number: 5,971,515

[45] Date of Patent: Oct. 26, 1999

[54] PROTECTED INTERNAL HINGE FOR SECURITY SAFE

[76] Inventors: Steven J. Baker, 14080 Scenic View Rd., Lake Mathews, Calif. 92570; William A. Horn, 2270 Wandering Ridge, Chino Hills, Calif. 91709

[21] Appl. No.: 09/103,137

[22] Filed: Jun. 22, 1998

[51] Int. Cl.[6] ..... A47B 88/00; E05D 7/00

[52] U.S. Cl. ..... 312/329; 16/221; 16/379; 109/74

[58] Field of Search ..... 312/329, 326, 312/109, 138.1, 100; 16/374, 379, 221; 49/383; 109/73, 74, 75, 77, 64

[56] References Cited

U.S. PATENT DOCUMENTS

| | | | |
|---|---|---|---|
| 406,848 | 7/1889 | Mosler et al. . | |
| 1,605,296 | 11/1926 | Silvers | 312/329 X |
| 2,645,743 | 7/1953 | Smidt | 312/329 X |
| 4,629,265 | 12/1986 | Chester | 312/329 |
| 4,704,970 | 11/1987 | Sanderson et al. . | |
| 4,878,267 | 11/1989 | Roach et al. . | |
| 4,979,264 | 12/1990 | Ramsauer | 16/379 X |
| 5,232,277 | 8/1993 | Cassady et al. | 16/221 X |
| 5,407,263 | 4/1995 | Jones et al. | 312/329 X |
| 5,490,306 | 2/1996 | Floyd et al. . | |
| 5,544,595 | 8/1996 | Stephenson, III et al. . | |
| 5,666,695 | 9/1997 | Jegers et al. . | |

FOREIGN PATENT DOCUMENTS

| | | | |
|---|---|---|---|
| 578577 | 1/1994 | European Pat. Off. | 16/221 |

*Primary Examiner*—Peter M. Cuomo
*Assistant Examiner*—James O. Hansen
*Attorney, Agent, or Firm*—Gordon K. Anderson

[57] ABSTRACT

A security safe that incorporates a cabinet (20) formed of sheetmetal, including a front (22) and a door jamb (30). A door (42) for the safe is also formed of sheetmetal and has a jamb stop (48), box section (50) with a front flange (52) into which a series of hinge knuckles (58) are formed. A continuous hinge leaf (60) is plug welded (62) to an inside surface of the cabinet front and a hinge pin (64) unites the knuckles to the hinge leaf. The cabinet door jamb hinge knuckles and hinge leaf extend continuously the full height of the door. The hinge combination is completely hidden within the cabinet forming a secure barrier, as no access to the hinge is provided from the outside, nor is it at all visible, even when the door is open. This arrangement forms a secure barrier preventing unauthorized entry and in the event the door is forcibly jimmied and bent inwardly, the hinge remains totally inaccessible. A second embodiment differs in that a complete separate continuous hinge is utilized, instead of the integral knuckles in the door front flange.

13 Claims, 4 Drawing Sheets

PROTECTED INTERNAL HINGE FOR SECURITY SAFE

TECHNICAL FIELD

The present invention relates to hinges for safes in general and, more particularly, to a security safe having a continuous hinge positioned entirely behind the front structure of the cabinet and the door, including a protective barrier formed integrally within the door structure and cabinet corner configuration.

BACKGROUND ART

Previously, many types of hinges have been used in safes in endeavoring to provide an effective means for protecting the hinge from forcible entry. Some prior art has utilized an offset continuous hinge attached to a full width door and the gap on the side of the safe, others have used single hinge leaves with the mating leaf formed integrally with the safe wall structure. An attempt to hide and protect the hinge was developed that included an extended narrow leaf attached to the door and a welded bracket and pin on the inside of the front wall.

A search of the prior art did not disclose any patents that read directly on the claims of the instant invention, however, the following U.S. patents are considered related:

| Patent No. | Inventor | Issue Date |
|---|---|---|
| 5,666,695 | Jegers et al | Sep. 16, 1997 |
| 5,544,595 | Stephenson, III et al | Aug. 13, 1996 |
| 5,490,306 | Floyd et al | Feb. 13, 1996 |
| 4,878,267 | Roach et al | Nov. 7, 1989 |
| 4,704,970 | Sanderson et al | Nov. 10, 1987 |
| 406,848 | Mosler et al | Jul. 9, 1889 |

Jegers et al in U.S. Pat. No. 5,666,695 teaches a leaf member having a pair of knuckles that include a retainer, which extends into the path of the pin. Annular grooves formed in the pin receive the retainer member and keep it from sliding in or out of the hinge. One of the grooves has a straight side and a tapered side, allowing the pin to slide over the second groove but not the first. The structure of the safe corner is bent to form at least one knuckle and leaf member to mate with the second hinge leaf.

U.S. Pat. No. 5,544,595, issued to Stephenson, III et al, discloses a hinge arrangement for a gaming device that includes a hinge connecting a door to a cabinet with a gap inbetween when the door is closed. The hinge forms a pocket shaped barrier around the gap with an edge engaging a side of the pocket when pivoted 90 degrees, limiting its travel, precluding damaging adjacent gaming devices when the door is opened.

Floyd et al in their U.S. Pat. No. 5,490,306 is for a security cover for a barrel hinge having an inner cover plate.

U.S. Pat. No. 4,878,267, issued to Roach et al, discloses a device for resisting entry of an object into a space between the hinged edge of a door and a jamb using a folded sheet of flexible material.

Sanderson et al, in U.S. Pat. No. 4,704,970, teaches a hinge assembly of a planar-surfaced mounting bracket and a J-shaped leaf member. A mounting bracket, in hex shape, is welded to the inner surface of the safe cabinet and the leaf member includes a pin that is retained by the bracket. The leaf member penetrates an open section of the frame and forms a door stop when contiguously abutting therebetween.

For background purposes and as indicative of the art to which the invention is related, reference may be made to the remaining cited patent issued to Mosler et al.

DISCLOSURE OF THE INVENTION

The purpose of any security safe is to provide a place to keep valuable objects protected, free from unauthorized entry, fire and disastrous acts of nature. A door must be included in any safe, since access is required by the one protecting their valuables. Historically, locks have been used for this purpose and are well known in the art, particularly large and robust bolt work has been utilized in safes for centuries to secure the door when it is closed. In security safes, of the size and configuration to store firearms, particularly rifles and shotguns, spring-loaded detent bolt work with manual or electronic locks and spring-loaded relockers are used to assure the desired protection. This locking defense has developed over time into a fine art and much effort has been directed to its development as the primary security measure for protecting a door.

The hinge for the door has always been vulnerable, as it is necessary for functional operation and, in some instances, is actually exposed on the outside of the safe making it easily accessible. The hinge has seen little improvement over the years as it is rather basic in its design, using a pin circularly enclosed on both a fixed side and a movable side. It is, therefore, a primary object of the invention to protect the hinge by placing it in an area that is basically hidden from the outside and completely internal to the structure. This positioning arrangement is accomplished by placing the hinge behind a narrow portion of the cabinet front between the door jamb and the side. In order to attach the door to the hinge, a box-like arrangement is integrally fabricated into the door structure, even including an offset jamb stop. This arrangement permits the door to open a full 90 degrees for complete access into the safe's interior, while hiding the hinge behind the formed structure.

An important object of the invention is the use of an integral continuous hinge for door attachment. Since the hinge is now completely contained within the safe's interior, breaching of the door by removal of the hinge is virtually impossible, as the entire front portion of the enclosure must be broken open or separated. Further, a continuous hinge running the full height of the door provides an extended bearing surface, as the hinge knuckles are present the entire height, as contrasted by two or three separate conventional leaf hinges each having only a few knuckles of a relatively small size. By utilizing a continuous hinge, the heavy door is not subjected to sagging and the inertial forces on the structure caused by the cantilever effect are evenly distributed over the full height of the entire cabinet opening.

Another object of the invention in the preferred embodiment is that the hinge is formed integrally with the front flange of the door and a separate single hinge leaf is welded to the cabinet on an inside surface with a metallic pin inserted into the adjoining hinge knuckles. This method of construction yields an extremely strong and durable joint, as there is no way to separate the leaf from the door, since the knuckles are mechanically formed from the parent metal. The separate leaf is welded to the inside of the cabinet front by plug welding through slots punched into the cabinet and then the weld is ground smooth such that it is impossible from the outside to tell where the welds are located, and every weld would require removal to free the hinge leaf from the cabinet.

Still another object of the invention is the forming of the hinge knuckles into the door saves material and the labor to weld a mating leaf onto the door. Further, since the door is formed of a single segment of flat metal sheetstock, handling of separate components is eliminated, again saving basic labor and storage space.

These and other objects and advantages of the present invention will become apparent from the subsequent detailed description of the preferred and other embodiments, also the appended claims, further, taken in conjunction with the accompanying drawings.

BEST MODE FOR CARRYING OUT THE INVENTION

Figure 1:
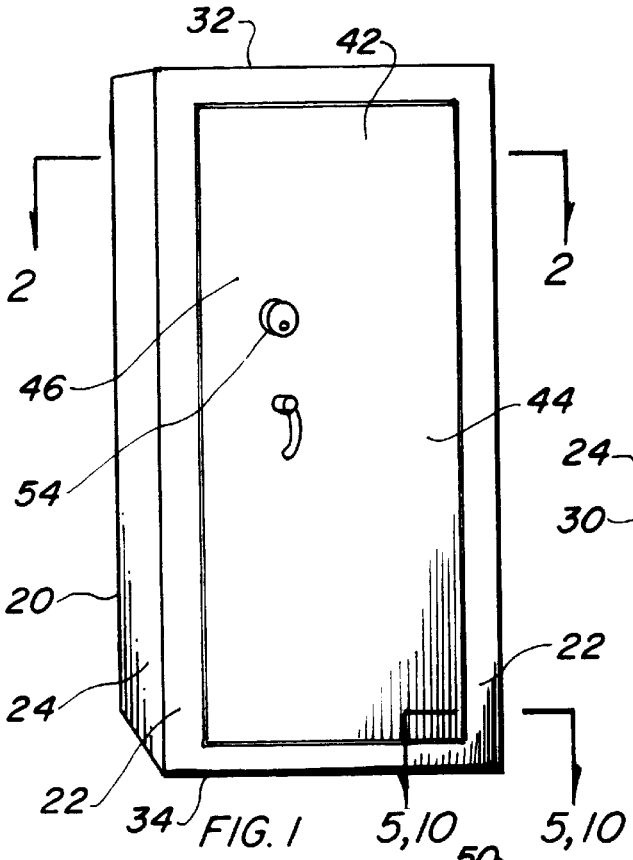
FIG. 1 is a perspective view of the preferred embodiment with the door closed.
Figure 2:
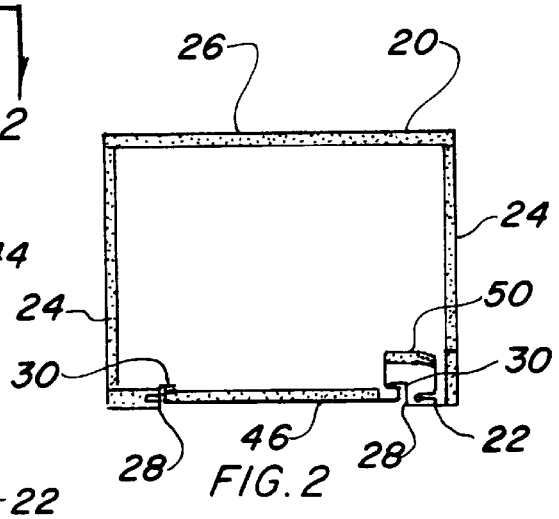
FIG. 2 is a cross-sectional view taken along lines 2—2 of FIG. 1.
Figure 3:
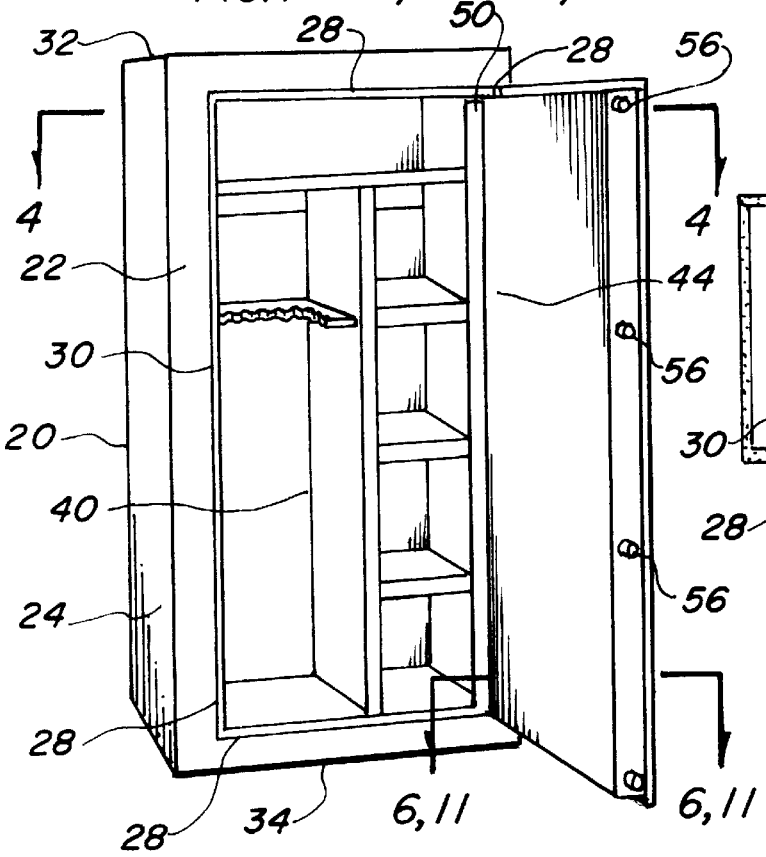
FIG. 3 is a perspective view of the preferred embodiment with the door open.
Figure 4:
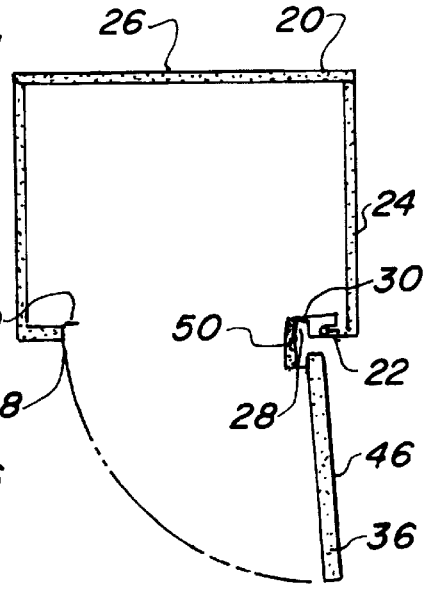
FIG. 4 is a cross-sectional view taken along lines 4—4 of FIG. 3.

The best mode for carrying out the invention is presented in terms of a preferred and second embodiment. Both embodiments are primarily designed alike, except the preferred embodiment contains integral formed hinge knuckles, and the second embodiment utilizes a separate single hinge leaf and pin forming the continuous hinge. Both embodiments contain the same structure for the door and cabinet.

The preferred embodiment, as shown in FIGS. 1 through 9, is comprised of a cabinet 20, formed of a single segment of flat metal sheetstock. The cabinet 20 includes a front 22, sides 24, and a back 26, formed to define an access opening 28 with the front configured to create a flanged upwardly recessed door jamb 30. The cabinet 20 is formed on a press brake, preferably using carbon steel, such as hot rolled steel that has been pickled and oiled of a thickness from 12 gauge 0.104 inches (0.264 cm) to ¼ inch (0.635 cm), according to the size and desired strength of the security safe. A top 32 and bottom 34 are fabricated of the same material and continuously welded to the single sheet that has been formed into the front, sides and back completing the cabinet 20, as depicted in FIGS. 1 through 4. The cabinet 20 may be unlined or contain a fireproof lining of non-flammable insulation 36, along with a heat activated self-sealing gasket 38 attached around the access opening 28, as well as the door jamb 30. Optional interiors 40, such as high density fiberboard with solid oak facing and a lint free foam back material configured as shelves, rifle stalls, or a combination thereof may also be utilized within the cabinet 20.

Figure 5:
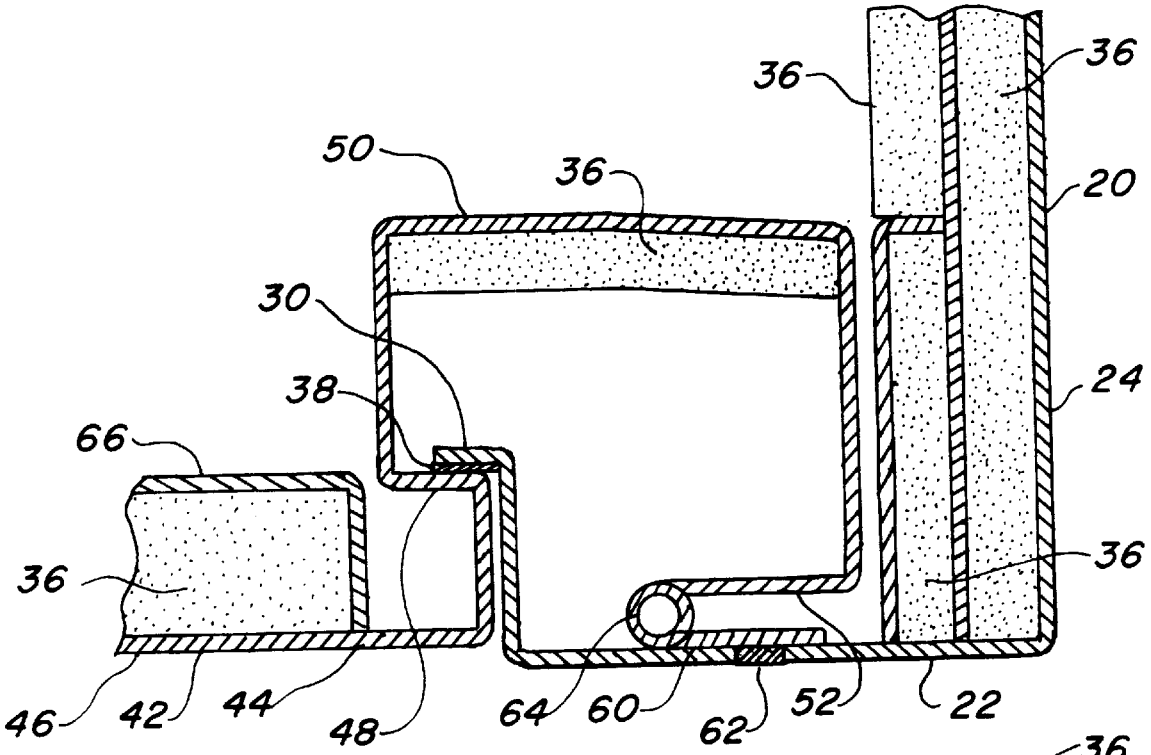
FIG. 5 is a cross-sectional view taken along lines 5—5 of FIG. 1 illustrating the door jamb and door internal hinge in a closed position.
Figure 6:
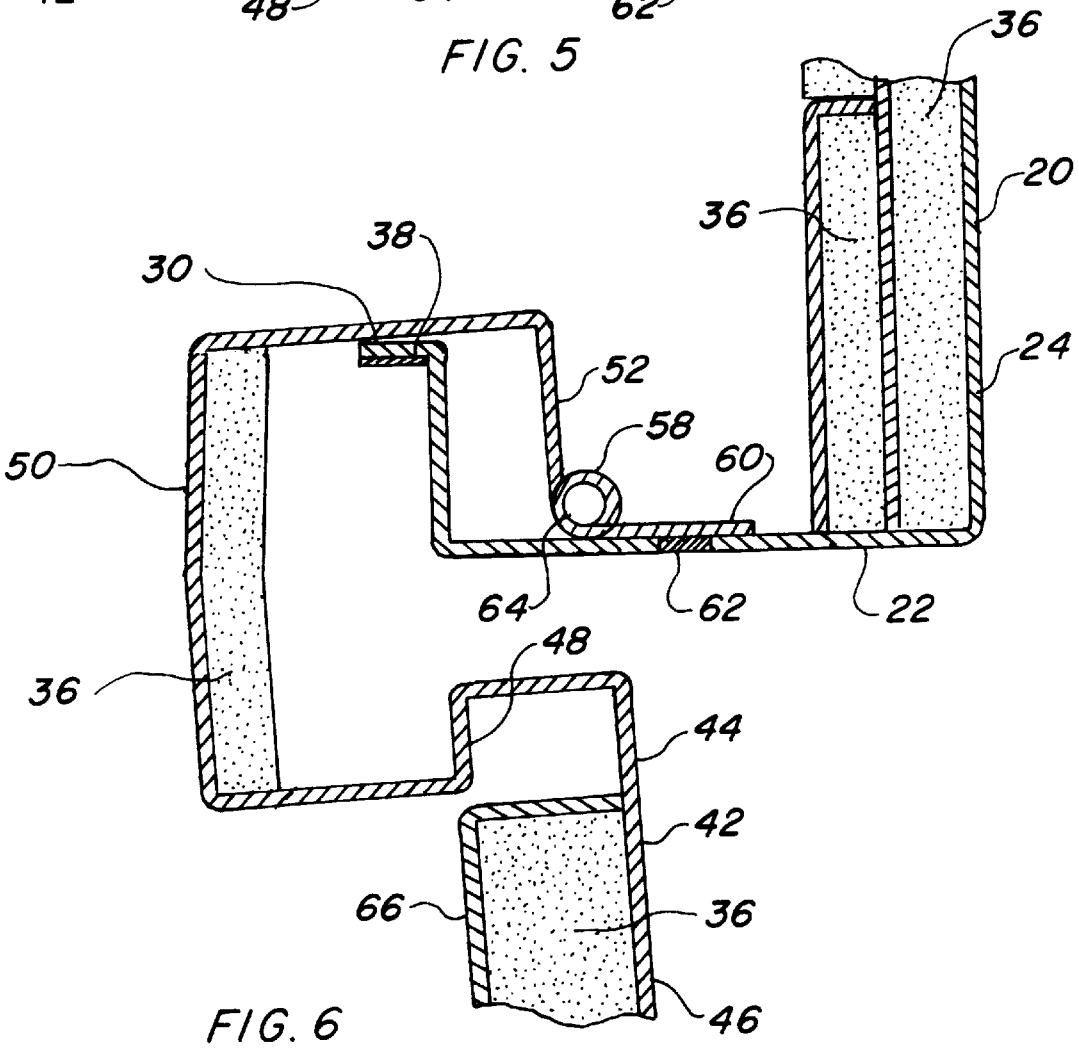
FIG. 6 is a cross-sectional view taken along lines 6—6 of FIG. 3 illustrating the door jamb and door internal hinge in a open position.

A door 42 is also formed from a single segment of flat metal sheetstock of similar material to the cabinet. The door 42 includes a hinge side 44 consisting of a front 46, an offset jamb stop 48, a box section 50, including a front flange 52 defining an open gap between the stop 48 and the flange 52. The door hinge side 44 is illustrated in FIGS. 5 and 6 and depicts the insulation 36 and gasket 38 in both the door closed and door open positions, respectively.

Both the cabinet 20 and door 42 are characterized by the absence of through-hole and any visible mounting hardware for internal components with the outside surface smooth and obstruction free. The door 42 normally contains lockwork 54 and the locking bolts 56 of selected configurations, all well known in the art.

Figure 7:
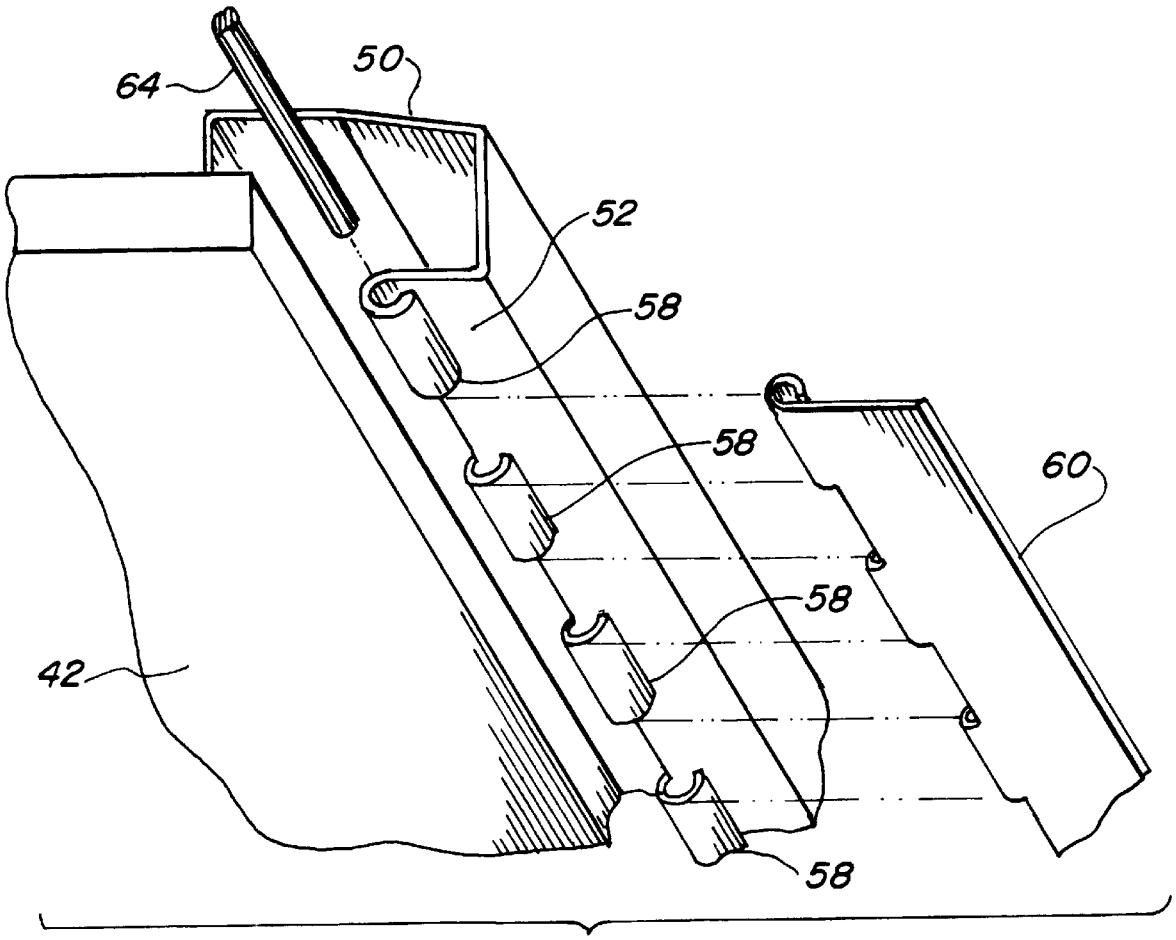
FIG. 7 is a partial exploded view of the integral hinge leaf, single hinge leaf and hinge pin depicting their relationship.
Figure 8:
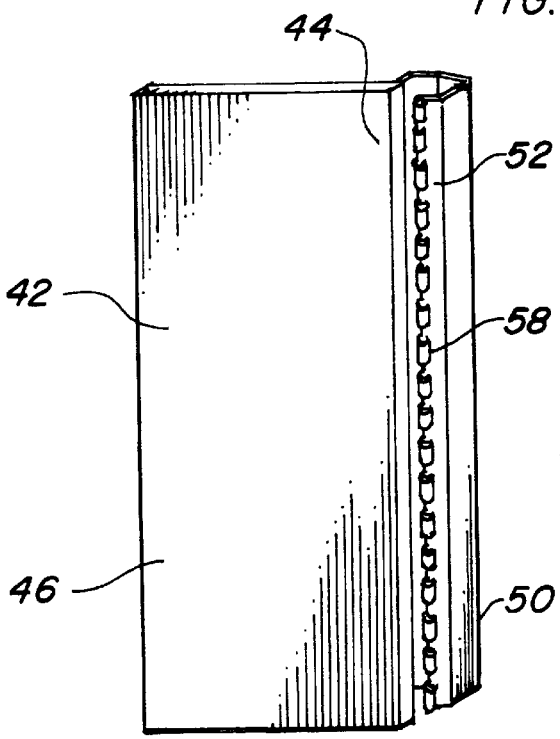
FIG. 8 is a partial isometric view of the front of the door completely removed from the invention for clarity.
Figure 9:
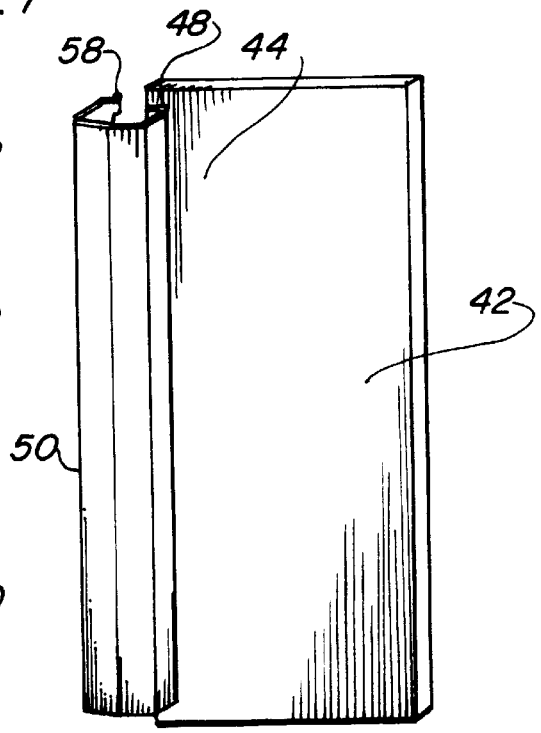
FIG. 9 is a partial isometric view of the back of the door completely removed from the invention for clarity.

The novelty of the invention resides basically in the hinge side 44 of the door, also the front 22 and door jamb 30 of the cabinet on the hinged side. The door box section front flange 52 incorporates a series of hinge knuckles 58 formed integrally with the flange, as shown in FIGS. 7 through 9. The knuckles 58 are fabricated by punching a succession of notches in spaced sequence in the flat along the outside edge and then rolling the remaining ends in a circular configuration by two separate hits with consecutive press brake forming dies. This method of construction is normally used to fabricate single leafs of a continuous hinge and has been in use for decades, however, when formed as an integral part of the cabinet, the hinge becomes much stronger, as it does not rely on some type of fastening of a leaf to the parent metal, as is in conventional usage.

A single continuous hinge leaf 60 is permanently affixed to an inside surface of the cabinet front 22, meshing with the hinge knuckles 58 formed into the door front flange 52. The permanent method of attachment is accomplished by welding, using a plug weld 62, as illustrated in FIGS. 5 and 6, wherein a slot or hole is punched into the cabinet front 22 in the flat and the hinge leaf 60 is aligned directly over this opening. After the cabinet is formed and the top 32 and bottom 34 are attached, a weld is disposed within the opening completely filling the slot or hole with metal. Eventually, the outside face of the weld is ground flush with the surface of the cabinet 20 completely hiding the attachment point, especially after the entire cabinet is painted. The number and location of the plug welds 62 varies with the size of the safe and the thickness of the cabinet and hinge leaf 60.

A hinge pin 64 is inserted into the knuckles 58 formed into the door front flange 52 and through the hinge leaf 60 pivotally attaching the door 42 to the cabinet 20. This connection means permits the door to swing freely in an arcuate manner away from the cabinet front door jamb 30 until it is stopped by impinging on the door jamb, as illustrated in FIG. 6.

The cabinet door jamb 30, door hinge side 44 and hinge leaf 60 extend continuously from the top to the bottom of the cabinet 20, as shown in FIGS. 1, 3, 8 and 9, making the hinge continuous, forming a strong and robust association.

While the novelty resides basically in the connection of the door 42 to the cabinet 20 where the box section 50 of the door not only interfaces with the cabinet door jamb 30 to accomplish a seal by compressing the gasket 58, but forms a secure barrier, as the hinge is completely hidden behind the cabinet front 22. FIGS. 5 and 6 illustrate this internal hinge relationship, as it may be plainly seen that there is absolutely no access to the hinge from the outside of the safe, even when the door is open. The configuration of the safe allows it to form its own secure barrier, preventing forcible entry since the hinge is completely hidden behind the cabinet front 22 and no access to the hinge is available or even visible. If the cabinet 20 and door 42 are jimmied by a forcible implement, such as a pry bar, and the cabinet door jamb 30 is bent inwardly toward the side 24, the hinge knuckles 58, hinge leaf 60 and pin 64 remain totally inaccessible.

To further strengthen the door 42 itself, a metallic insulation barrier 66, in pan shape with flanges bent on one or more sides, is welded to the door on the interior side. This barrier 66 encloses and protects the insulation 36 within the door and is contiguous with the offset jamb stop 48, such that if the cabinet door jamb 30 is attempted to be pried apart, the barrier 66 acts as a reinforcement, thus increasing the doors structural integrity. FIGS. 5 and 6 illustrate this barrier 66 in cross-section and FIG. 9 depicts the back side of the door with the barrier in place.

Figure 10:
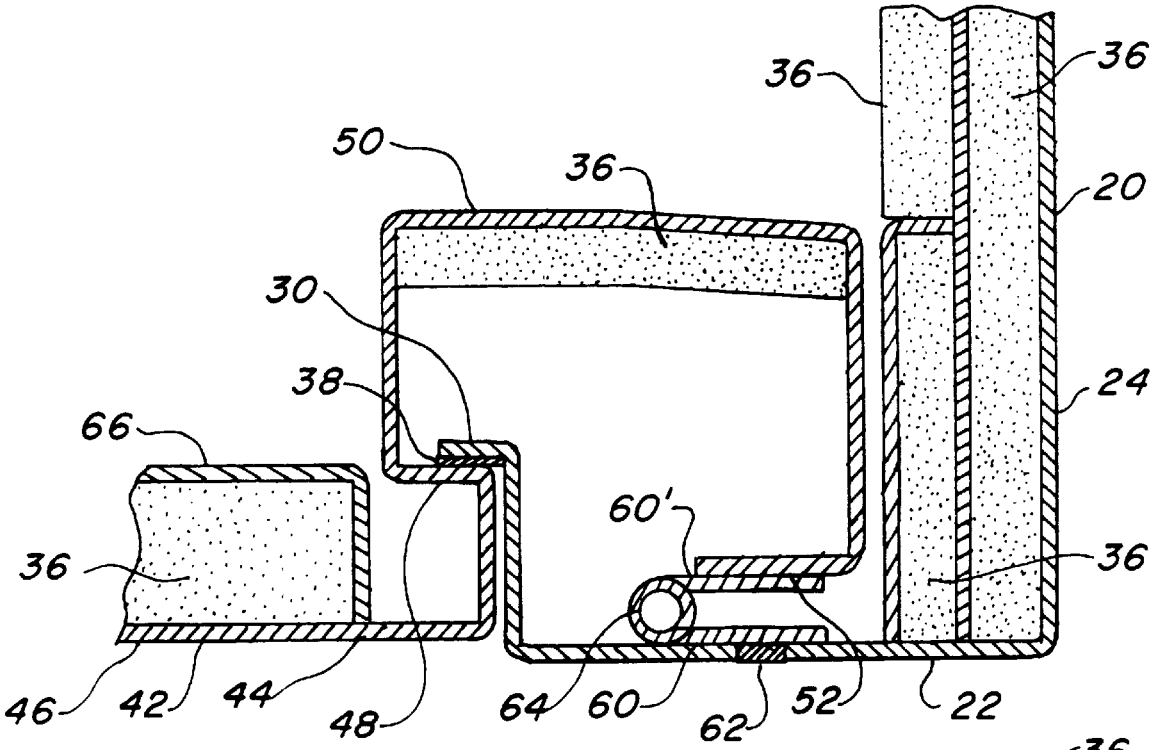
FIG. 10 is a cross-sectional view taken along lines 10—10 of FIG. 1 of the second embodiment with the door closed.
Figure 11:
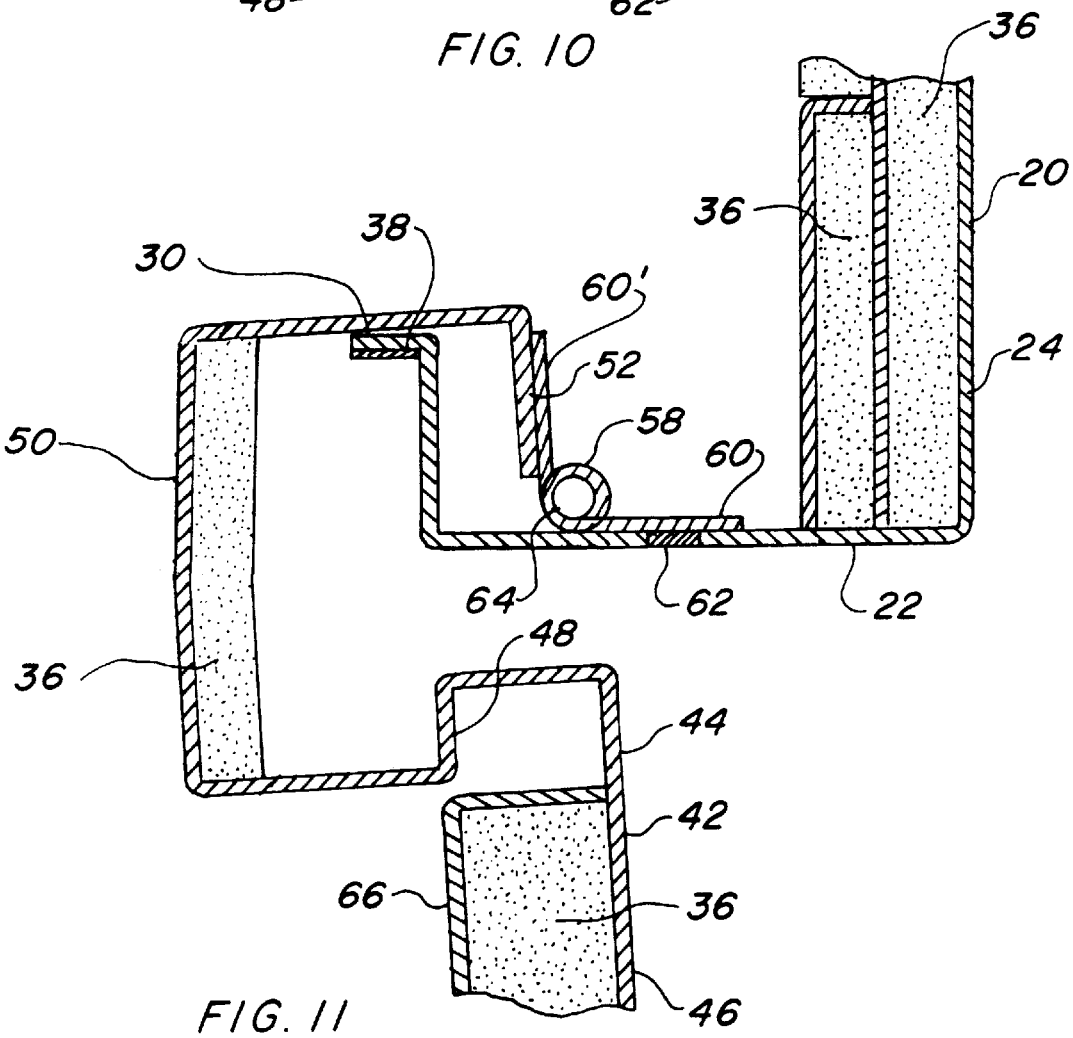
FIG. 11 is a cross-sectional view taken along lines 11—11 of FIG. 3 of the second embodiment with the door open.

The second embodiment is illustrated in FIGS. 10 and 11 and is identical to the preferred embodiment, with the exception that the hinge knuckles 58 are not formed integrally into the front flange 52 of the doors box section 50, instead a mating continuous hinge leaf 60' is welded onto the front flange 52 prior to assembly of the door to the cabinet. This embodiment affords all of the protective qualities and differs only in the strength of the hinge leaf attachment, however, all of the uniqueness still applies to the hidden hinge arrangement and structure.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A protected internal hinge for a security safe comprising:

a cabinet having a front, sides and a back with an access opening in the front defining a flanged inwardly recessed door jamb, a door defining a hinge side, having a door front, an offset jamb stop, a box section including a front flange with the stop and the flange having an open gap therebetween, said jamb stop contiguous with the cabinet door jamb when the door is closed, a continuous hinge on an inside surface of the cabinet front and on said door front flange permitting the door to swing freely away from the cabinet with the door box section pivoting into the cabinet front and door jamb until arrested by the jamb, and said cabinet door jamb, door hinge side and hinge extending continuously from a top to a bottom of the cabinet and door such that they form a secure barrier preventing unauthorized entry into the cabinet if the cabinet and door are jimmied by a forcible pry implement and bent inwardly allowing the hinge to remain totally inaccessible.

2. A protected internal hinge for a security safe comprising:

a cabinet having a front, sides and a back with an access opening in the front defining a flanged inwardly recessed door jamb, a door defining a hinge side, having a front, an offset jamb stop, a box section including a front flange with the stop and the flange having an open gap therebetween, said jamb stop contiguous with the cabinet door jamb when the door is closed, said door box section front flange having a plurality of hinge knuckles formed integrally with the flange, and a single contiguous hinge leaf permanently affixed to an inside surface of the cabinet front meshing with said hinge knuckles formed into the door front flange, a hinge pin disposed within the knuckles of the door front flange and the hinge leaf in concert constituting an internal hinge, said internal hinge forming an arcuate connection permitting the door to swing freely away from the cabinet with the door box section pivoting into the cabinet front and door jamb until arrested by the jamb, and said cabinet door jamb, door hinge side and hinge leaf extending continuously from a top to a bottom of the cabinet and door such that the cabinet door jamb and door hinge side forms a secure barrier preventing unauthorized entry into the cabinet if the cabinet and door are jimmied by a forcible pry implement and bent inwardly permitting the hinge knuckles, leaf and pin to remain totally inaccessible.

3. The protected internal hinge as recited in claim 2 wherein said cabinet and door are characterized by an absence of through-holes and mounting hardware for attachment of the hinge such that the safe forms a secure barrier preventing entry as the hinge is completely hidden behind the cabinet front and no access to the hinge is visible.

4. The protected internal hinge as recited in claim 2 wherein said cabinet front, sides and back are formed from a single segment of flat metal sheetstock.

5. The protected internal hinge as recited in claim 2 wherein door is formed from a single segment of flat metal sheetstock.

6. The protected internal hinge as recited in claim 2 further comprising an internal insulation barrier attached to an inside surface of the door front contiguous with the offset jamb stop such that if the door jamb is pried, the barrier acts as a reinforcement, thus increasing the doors structural integrity.

7. The protected internal hinge as recited in claim 2 wherein said continuous hinge leaf is permanently affixed to the cabinet and door by welding.

8. A protected internal hinge for a security safe comprising:

a cabinet having a front, sides and a back with an access opening in the front defining a flanged inwardly recessed door jamb, a door defining a hinge side, having a front, an offset jamb stop, a box section including a front flange with the stop and the flange having an open gap therebetween, said jamb stop contiguous with the cabinet door jamb when the door is closed, a continuous hinge permanently affixed to both an inside surface of the cabinet front and to said door front flange permitting the door to swing freely away from the cabinet with the door box section pivoting into the cabinet front and door jamb until arrested by the jamb, and said cabinet door jamb, door hinge side and hinge extending continuously from a top to a bottom of the cabinet and door such that they form a secure barrier preventing unauthorized entry into the cabinet if the cabinet and door are jimmied by a forcible pry implement and bent inwardly allowing the hinge to remain totally inaccessible.

9. The protected internal hinge in claim 8 wherein said cabinet and door are characterized by an absence of through-holes and mounting hardware for attachment of the hinge such that the safe forms a secure barrier preventing entry as the hinge is completely hidden behind the cabinet front and no access to the hinge is visible.

10. The protected internal hinge as recited in claim 8 wherein said cabinet front, sides and back are formed from a single segment of flat metal sheetstock.

11. The protected internal hinge as recited in claim 8 wherein door is formed from a single segment of flat metal sheetstock.

12. The protected internal hinge as recited in claim 8 further comprising an internal insulation barrier attached to an inside surface of the door front contiguous with the offset jamb stop such that if the jamb is pried, the barrier acts as a reinforcement, thus increasing the doors structural integrity.

13. The protected internal hinge as recited in claim 8 wherein said continuous hinge is permanently affixed to the cabinet and door welding.

* * * * *